United States Patent [19]

Ashton et al.

[11] Patent Number: 4,898,067

[45] Date of Patent: Feb. 6, 1990

[54] COMBING APPARATUS FOR BRAIDING MACHINE

[75] Inventors: Clint H. Ashton, Warrenton; Gerald A. Patterson, Manassas, both of Va.

[73] Assignee: Atlantic Research Corporation, Alexandria, Va.

[21] Appl. No.: 374,988

[22] Filed: Jul. 3, 1989

[51] Int. Cl.[4] ..... D04C 1/06; D04C 3/00; D04C 3/48

[52] U.S. Cl. ..... 87/8; 87/33; 87/36

[58] Field of Search ..... 87/1, 5–9, 87/11, 24–26, 28–30, 33–36, 61, 62

[56] References Cited

U.S. PATENT DOCUMENTS

| | | | |
|---|---|---|---|
| 3,426,804 | 2/1969 | Bluck | 87/33 X |
| 4,312,261 | 1/1982 | Florentine | 87/33 |
| 4,614,147 | 9/1986 | Vendramini | 87/8 X |
| 4,615,256 | 10/1986 | Fukuta et al. | 87/33 X |
| 4,621,560 | 11/1986 | Brown et al. | 87/8 |
| 4,719,837 | 1/1988 | McConnell et al. | 87/33 X |
| 4,753,150 | 6/1988 | Brown | 87/34 X |

*Primary Examiner*—John Petrakes
*Attorney, Agent, or Firm*—Frank P. Presta

[57] ABSTRACT

Combing apparatus for a braiding machine or the like, comprising a plurality of smooth, flexible lines mounted on one side of the fibers in the area between the braiding machine and the braid point. The lines are fixed at the end near the braiding machine and are attached at the opposite end to a flexible and resilient member, such as a spring or rubber band. A plurality of pusher members are mounted on the one side of the fibers in alignment with the lines, and a plurality of gripper members are mounted on the opposite side of the fibers in alignment with the lines and pusher members. The pusher members engage the lines in an area near the braiding machine so as to push them between the fibers. The gripper members extend through the fibers to grip the lines, pull them through the fibers and then pull the lines toward the braid point to separate and comb the fibers in a uniform manner.

12 Claims, 5 Drawing Sheets

COMBING APPARATUS FOR BRAIDING MACHINE

BACKGROUND OF THE INVENTION

The present invention relates to multi-ply braiding apparatus and, more particularly, to a new and improved apparatus for combing fibers in the area between a braiding machine and the braid point.

The process of braiding is distinguished from weaving in that all fibers are interchanged (moved) in a braiding cycle while in weaving only a single fiber (the fill) is moved through a fixed array of fibers (the warp). Multi-ply braiding is distinguished from conventional braiding in that more than two layers (plys) are formed by the process.

Any braiding process is characterized by the fact of all fiber carriers being in motion resulting in intertwined fibers. Multi-ply braiding machines use a matrix array of carriers capable of alternate row and column position shifts. Reversal of the direction of row and column motion during a complete shift cycle produces the intertwining of fibers. Production of complex shapes is possible by adjusting the length of travel (number of spaces shifted) of each row or column.

Multi-ply braiding concepts and machines are disclosed in the patents to Bluck U.S. Pat. No. 3,426,804, Florentine U.S. Pat. No. 4,312,261 and Brown U.S. Pat. No. 4,753,150. In the Bluck and Florentine patents, the teachings of which are incorporated herein by reference, each row and column consists of discrete eyelets or carrier blocks. In other machines presently in use, row motion is accomplished by shifting grooved track members containing fiber carriers. Column motion consists of shifting the discrete fiber carriers. In circular concepts, row motion is accomplished by shifting concentric rings or track members, as shown in FIG. 6 of the Florentine patent, or by shifting axially aligned rings of the same diameter in side by side relation, as shown in the Brown patent, the teachings of which are incorporated herein by reference. Column (radial or axial) motion again consists of shifting discrete carriers.

In braiding machines, it is necessary to comb the fibers in the area between the machine and the braid point for the purpose of preventing tangling of the fibers and producing a uniform braid. Up to the present time, such combing has been accomplished manually by hand or with rods. Manual combing is subject to certain disadvantages in that it is labor-intensive, slow and non-uniform, with the result that high-speed, automated braiding is not possible and uniform braids of a desired density are difficult to attain.

Accordingly, a need has arisen for an automated combing apparatus for a braiding machine or the like which can uniformly and rapidly comb fibers as they approach the braid point to produce uniform braids of a desired density.

SUMMARY OF THE INVENTION

The combing apparatus of the present invention comprises a plurality of smooth lines, such as monofilaments, mounted on one side of the fibers in the area between a braiding machine and the braid point. Pusher means are mounted on the one side of the fibers and gripper means are mounted on the opposite side of the fibers. The lines are fixed at one end near the braiding machine and are attached at the opposite end by a flexible and resilient means, such as a spring or rubber band, so that the lines can be extended through the fibers. The pusher means engage the lines in an area near the braiding machine so as to freely push them between the fibers. The gripper means extend through the fibers to grip the lines, pull them through the fibers and then pull the lines down to the braid point, thereby separating and combing the fibers accordingly. The pusher means and gripper means may be programmed for automatic operation so as to comb the fibers at predetermined intervals and in a predetermined sequence.

DESCRIPTION OF THE PREFERRED EMBODIMENTS

Figure 1:
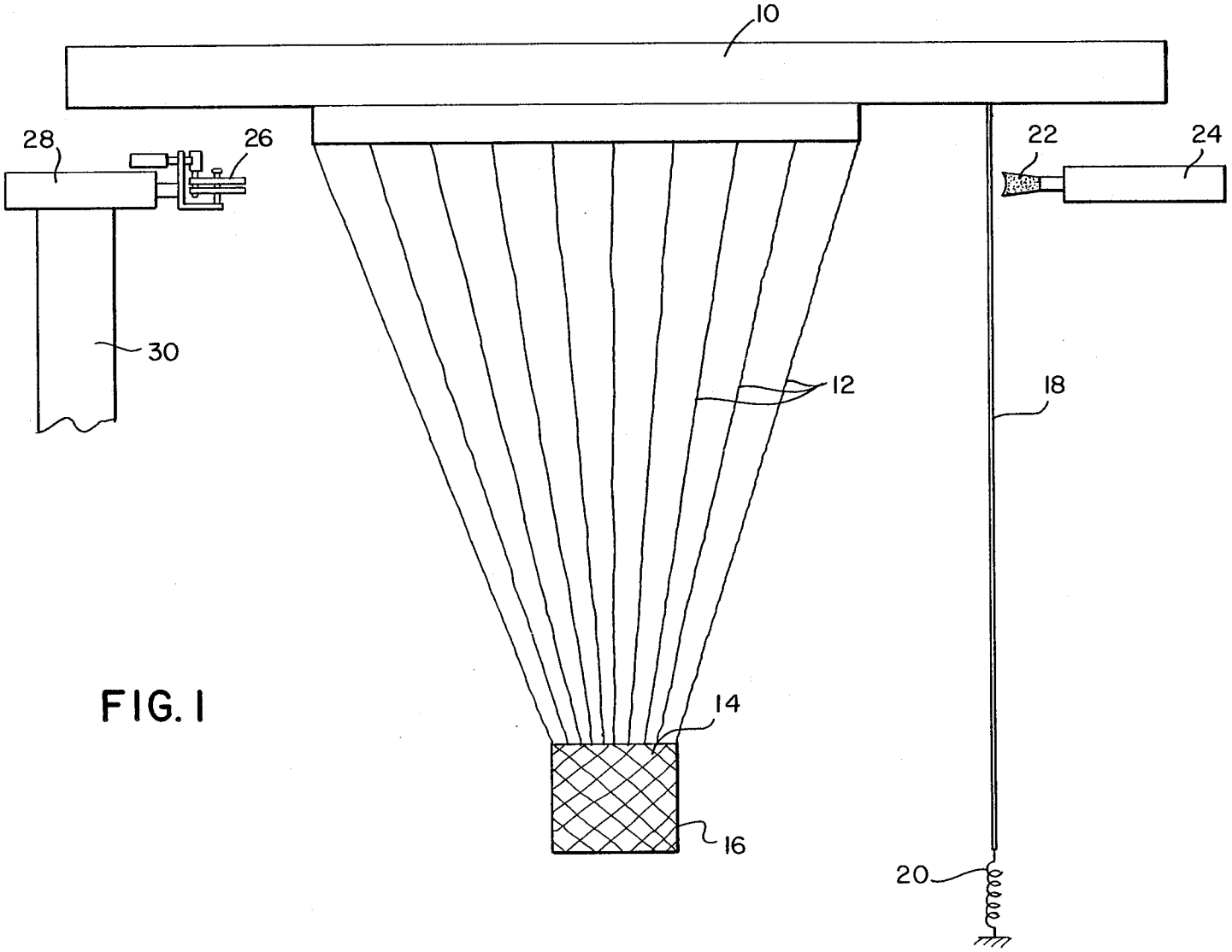
FIG. 1 is an end elevational, schematic view of a combing apparatus for a braiding machine or the like that is constructed in accordance with the principles of the present invention, showing the combing apparatus in a first mode of operation.
Figure 5:
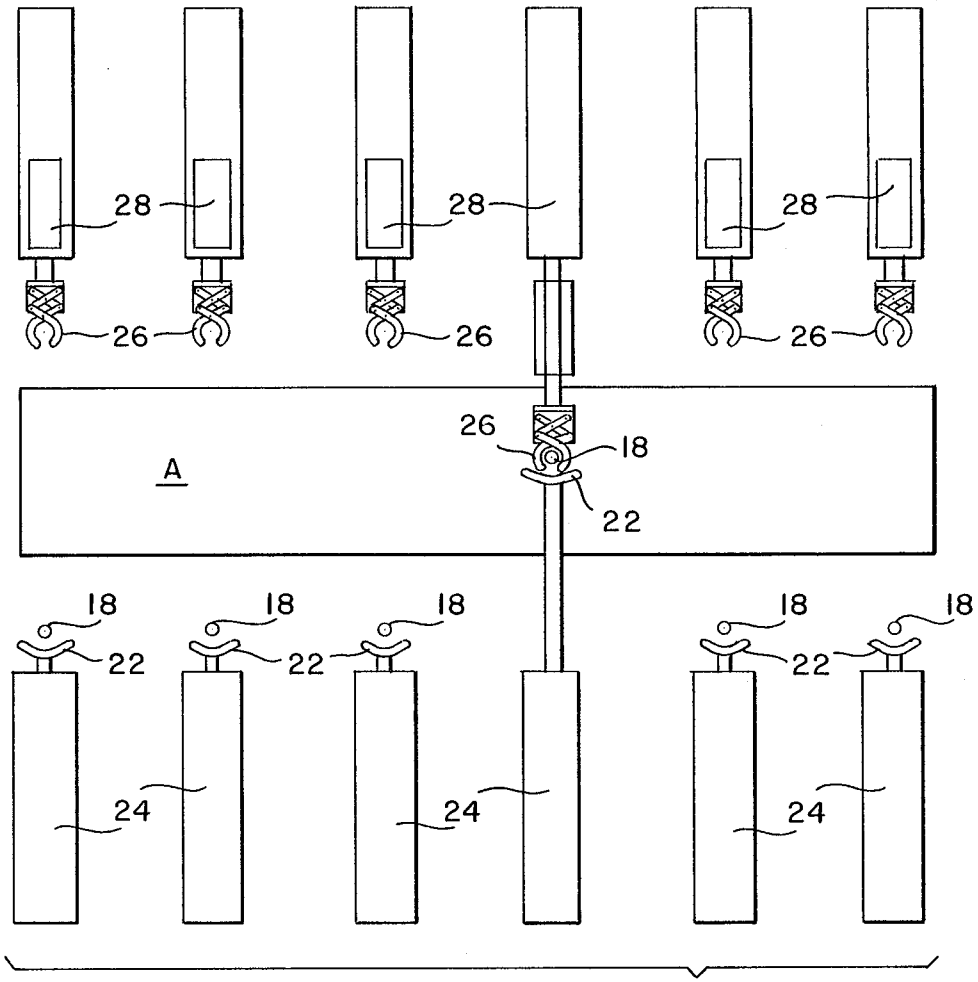
FIG. 5 is a plan view of the combing apparatus of the present invention, showing a portion of the apparatus in the first mode of operation illustrated in FIG. 1 and a portion of the apparatus in the second mode of operation illustrated in FIG. 2.

FIG. 1 illustrates a braiding machine 10 of any suitable type, such as those disclosed in the U.S. patents whose teachings are incorporated herein by reference. A plurality of fibers 12 extend from the braiding machine to a braid point 14 wherein they are braided to form a braided part 16 of any suitable or desired construction. A plurality of smooth, flexible lines 18, formed of monofilaments or the like, are mounted on one side of the fibers 12, preferably in substantially equally spaced relation along the braid area A, as shown in FIGS. 1 and 5. The upper ends of the lines 18 are fixed at or near the braiding machine 10 and the lower ends of the lines are secured to flexible and resilient members, such as springs 20, rubber bands or the like, that are anchored at a point beneath the braid point 14.

A plurality of pusher members 22 are mounted on the one side of the fibers 12 outside of and in alignment with the lines 18 near the upper ends thereof. The pusher members 22 are movable inwardly into the fibers 12 or braid area A by any suitable means, such as hydraulic piston and cylinder devices 24. A plurality of gripper members 26 are mounted on the other side of the fibers 12 or braid area A and are laterally aligned with the lines 18 and pusher members 22 as shown in FIG. 5. The gripper members are movable into and out of the fibers 12 or braid area A by any suitable actuating means, such as hydraulic piston and cylinder devices 28. In addition, the gripper members 26 are slidably mounted in any suitable manner on support posts 30 for movement therealong between the braiding machine and the braid point for a purpose to be more fully described hereinafter.

Figure 2:
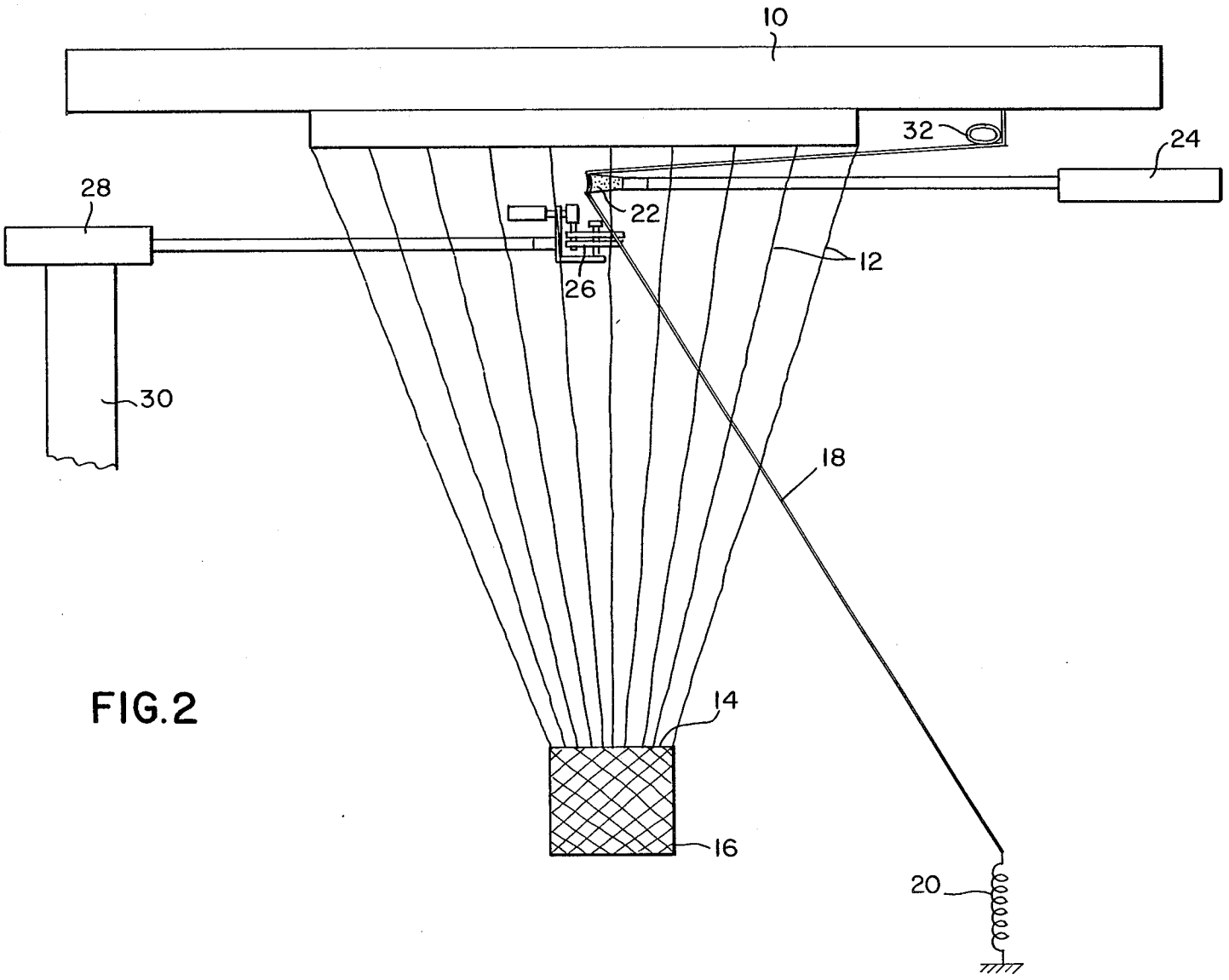
FIG. 2 is a view similar to FIG. 1, showing the combing apparatus in a second mode of operation.

In the operation of the combing apparatus of the present invention, the pusher members 22 are moved inwardly to engage the lines 18 and move them into the midpoint of the fibers 12 or braid area A in the manner shown in FIG. 2. At the same time, the gripper members 26 are moved into the midportion of the braid area A wherein they engage the lines 18 just beneath the pusher members 22 and pull them through the fibers 12 in the manner shown in FIG. 3.

Figure 3:
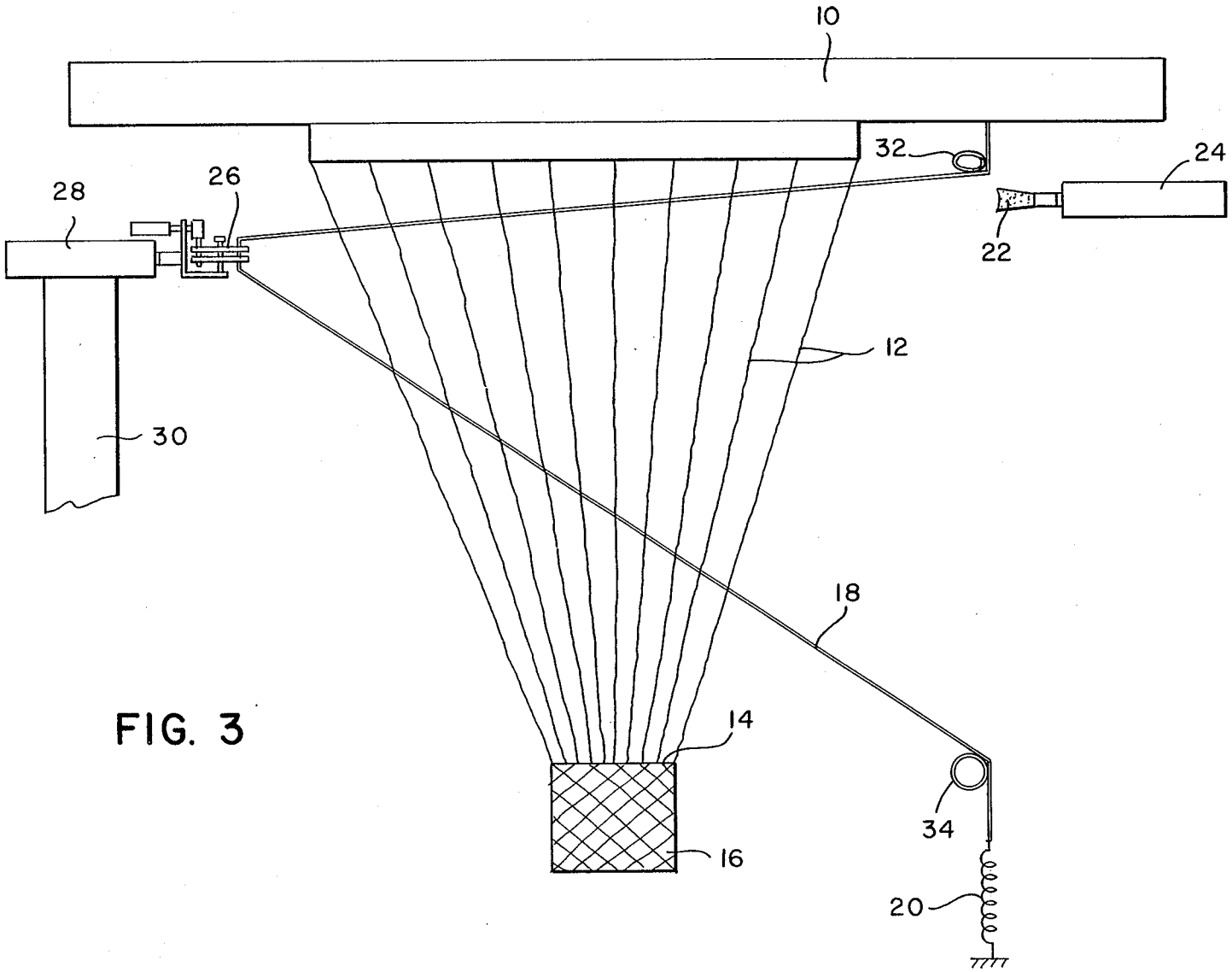
FIG. 3 is a view similar to FIG. 1, showing the combing apparatus in a third mode of operation.
Figure 4:
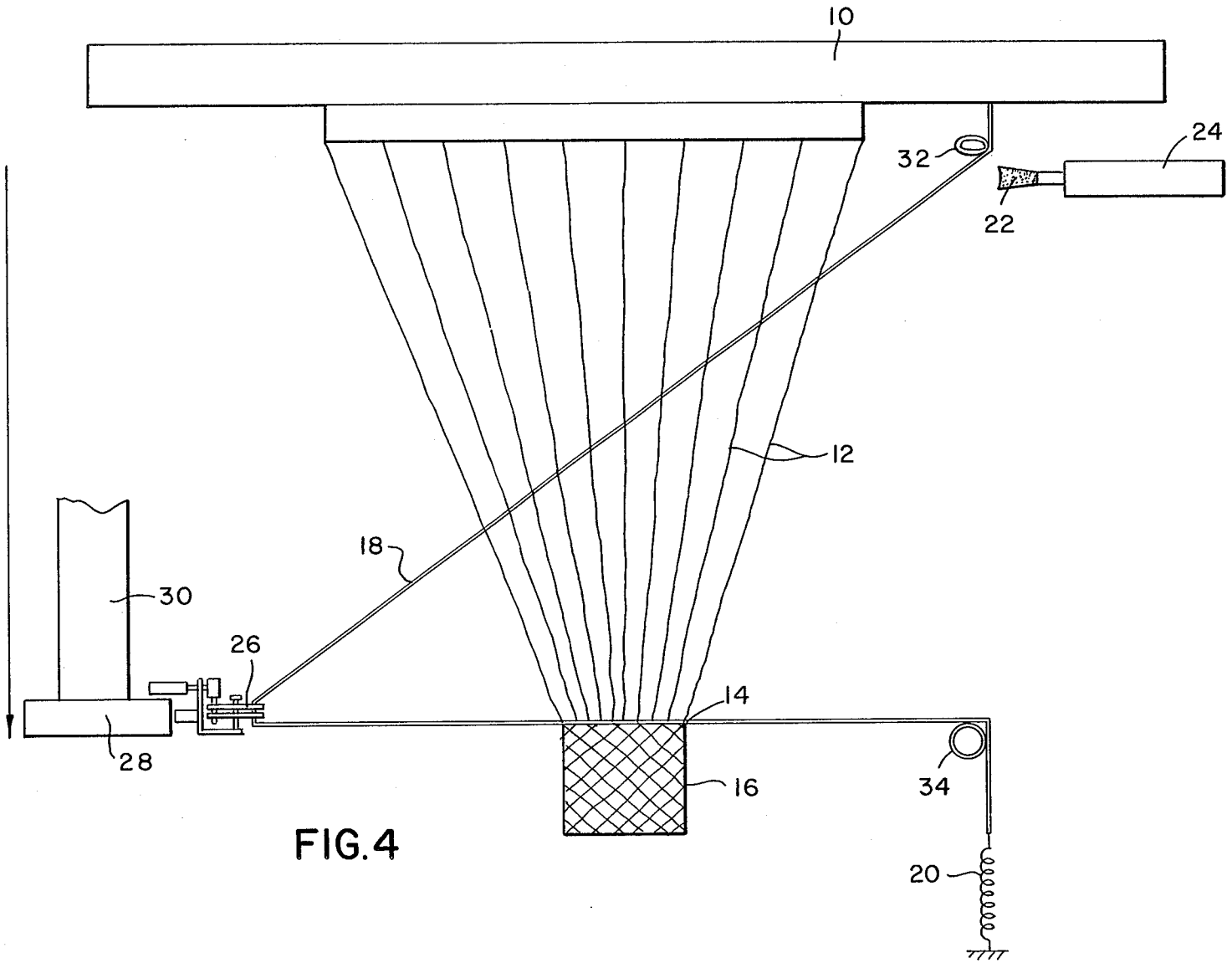
FIG. 4 is a view similar to FIG. 1, showing the combing apparatus in a fourth mode of operation.

After the lines 18 have been pulled through the fibers 12 by the gripper members 26, the gripper members are moved toward the braid point 14 along the support posts 30 to move the lines 18 through the fibers 12 to comb them down to the braid point 14, as shown in FIG. 4. For the purpose of controlling the angle or orientation of the lines 18 as they are pushed into the braid area A and pulled through the fibers 12, elongated members 30 and 32 may be positioned adjacent the upper and lower ends, respectively, of the lines 18 so that the lines will be deflected around these members as they are pushed and pulled into and through the fibers 12, as shown in FIGS. 2, 3 and 4.

The lines 18 may be spaced at any desired intervals with respect to the fibers 12, and the pusher members 22 and gripper members 26 may be operated in any desired sequence for the purpose of combing the fibers 12 in a desired manner, depending on the density or tightness of the braid desired. Suitable control means (not shown) may be provided to operate the pusher members and the gripper members in an automatic or programmed sequence for a predetermined combing of the fibers. In this manner, high-speed, automated braiding is possible and uniform braids of a desired density can by attained.

What is claimed is:

1. Apparatus for combing fibers extending from a braiding machine to a braid point for the formation of a braided article, comprising:

a flexible line positioned on one side of the fibers and extending generally between the braiding machine and the braid point;

means for pushing the line into the fibers near the braiding machine; and means for gripping the line when it is pushed into the fibers to pull the line through the fibers and toward the braid point, thereby separating and combing the fibers.

2. The apparatus of claim 1 wherein a plurality of flexible lines are positioned on one side of the fibers, and a plurality of pushing and gripping means are provided for pushing and pulling the lines through the fibers in a desired spacing and sequence.

3. The apparatus of claim 1 wherein one end of the line is fixed in position, and flexible and resilient means is connected to the other end of the line to enable it to be extended into and between the fibers.

4. The apparatus of claim 1 wherein said pushing means comprises a movable pusher member positioned on the one side of the fibers in alignment with the line, said pusher member being movable toward and away from the fibers.

5. The apparatus of claim 4 wherein said gripping means comprises a movable gripper member disposed on the other side of the fibers in alignment with the line, said gripper member being movable toward and away from the fibers and also being movable toward the braid point and away from the braiding machine or toward the braiding machine and away from the braid point.

6. The apparatus of claim 5 wherein said gripper member comprises movable jaws adapted to receive the line therebetween.

7. The apparatus of claim 5 wherein said pusher member and said gripper member are connected to and moved by movable piston and cylinder devices.

8. The apparatus of claim 5 wherein one end of the line is fixed in position, and flexible and resilient means is connected to the other end of the line to enable it to be extended into and between the fibers.

9. The apparatus of claim 8 wherein guide means are provided near both ends of the line to direct the line in a desired path as it is being pushed and pulled through the fibers.

10. The apparatus of claim 9 wherein said guide means comprise guide members positioned between the fibers and the line near the ends thereof, said guide members being engageable by the line to deflect it as it is being pushed and pulled through the fibers.

11. The apparatus of claim 1 wherein the line is a smooth monofilament line.

12. A method of combing fibers extending from a braiding machine to a braid point for the formation of a braided article, comprising the steps of:

positioning on one side of the fibers a flexible line extending generally between the braiding machine and the braid point;

pushing the line into the fibers near the braiding machine; and gripping the line pushed into the fibers and pulling it through the fibers toward the braid point to separate and comb the fibers.

* * * * *